United States Patent [19]

Kurachi et al.

[11] 4,382,705

[45] May 10, 1983

[54] TYPEWRITER WITH AN ERASING APPARATUS

[75] Inventors: Hisao Kurachi; Takeo Itoh; Hiroshi Onoda; Kiyomichi Okado; Susumu Kuzuya, all of Nagoya, Japan

[73] Assignee: Brother Kogyo Kabushiki Kaisha, Aichi, Japan

[21] Appl. No.: 285,035

[22] Filed: Jul. 20, 1981

[30] Foreign Application Priority Data

Jul. 25, 1980 [JP] Japan ..... 55-102806

[51] Int. Cl.[3] ..... B41J 29/36

[52] U.S. Cl. ..... 400/697.1; 400/301

[58] Field of Search ..... 400/697.1, 300, 301, 400/302

[56] References Cited

U.S. PATENT DOCUMENTS 3,882,990 5/1975 Genesio ..... 400/697.1

4,108,557 8/1978 Skrzipek et al. ..... 400/697.1

FOREIGN PATENT DOCUMENTS 2632567 1/1978 Fed. Rep. of Germany ... 400/697.1

*Primary Examiner*—Paul T. Sewell

*Assistant Examiner*—Daniel J. Roock

*Attorney, Agent, or Firm*—Browdy and Neimark

[57] ABSTRACT

A typewriter with a character erasing apparatus capable of consecutively erasing a series of characters as well as a single character once printed on a sheet of printing paper. The typewriter is provided with a retaining crank movable to first, second and third positions. In the first position the retaining crank retains a ribbon vibrator supporting an erase ribbon in non-operative status. In the second position the retaining crank permits the ribbon vibrator to operate while interrupting transmission of power for moving a platen. The retaining crank is automatically restored to the first position in response to return movement of the ribbon vibrator after the single character erasing. The retaining crank is moved to and held at the third position by a manual member for permitting the ribbon vibrator to operate consecutively. The retaining member does not interrupt the transmission of the power for moving the platen. Therefore, while the retaining crank is in the third position a series of characters are consecutively erased by usual typing.

11 Claims, 6 Drawing Figures

TYPEWRITER WITH AN ERASING APPARATUS

BACKGROUND OF THE INVENTION

This invention relates to a typewriter with an erasing apparatus capable of consecutively erasing a series of characters once printed on a sheet of printing paper.

A British Pat. No. 1,316,534 discloses a method of and apparatus for removing printed characters from a printing paper on which they have been printed by means of striking an erase ribbon having an adhesive surface on those printed characters. In this apparatus the characters have to be erased or removed by the same printing mechanism that has been used in the printing thereof.

In a typewriter provided with this erasing apparatus an erasing operation is carried out in the following manner when, for example, a printed character "H" is required to be erased.

A carriage of the typewriter is first of all spaced backwards by one character-size increment so as to set the next print position over the place where the character "H" has been printed, and at the same time or immediately thereafter the erase ribbon is so preset as to be ready for being lifted from an original position to a print position according to one character printing operation in a printing mechanism, just like a character printing ribbon such as an ink ribbon used in ordinary printing operations. A type "H" is then struck by the printing mechanism on the printed "H" via the erase ribbon.

In the ordinary printing operation every motion of the printing mechanism is delivered to a carriage driving mechanism upon printing of each character so as to advance the carriage by one character-size increment. When, however, the erasing apparatus is operated the printing mechanism is so preset as not to deliver the movement thereof to the carriage driving mechanism simultaneously with the preset of the erase ribbon. Consequently, the carriage is restricted to move even after the termination of the erasing operation.

Such a preset state is however released by the execution of the erasing operation, which allows the printing mechanism to print a new or correct character on the erased place when it is worked after the erasion. The carriage is then allowed to advance by one character-size increment.

In a typewriter having such an erasing apparatus an operator is obliged, when he or she consecutively erase or correct a series of characters, to space the carriage backwards and to preset the erase ribbon and a mechanism for non-escapement at each erasion of one character. This causes the erasing operation to be very complicated and troublesome.

SUMMARY OF THE INVENTION

It is a primary object of this invention, which has been made in view of the above, to provide a typewriter provided with an improved erasing apparatus.

It is another object of this invention to provide a typewriter provided with an erasing apparatus capable of consecutively erasing a series of characters by a simple operation.

It is still another object of this invention to provide a typewriter provided with an erasing apparatus wherein a preset state thereof for erasing one character is different from that for erasing a series of characters.

It is further object of this invention to provide a typewriter having a novel erasing apparatus of simple structure requiring not many parts.

According to the present invention there is provided a typewriter with an erasing apparatus comprising (1) means for printing selected characters, (2) erasing means for supporting an erase ribbon to move the same from original position to printing position in response to printing operation of the printing means, (3) a retaining member disposed movably among first, second and third positions and normally positioned at the first position to retain the erasing means in non-operative status, (4) manual operating means for moving the retaining member selectively to either one of the second position and the third position to allow the erasing means to operate in response to the printing operation of the printing means, and (5) means for locking the retaining member at the selected second or third position, wherein the retaining member when held at the second position by the locking means is returned to the first position in response to return movement of the erasing means from the printing position to the original position, and the retaining member when held at the third position by the locking means allows the erasing means to consecutively operate in response to the printing operation of the printing means.

This invention is highly effective, irrespective of its simple structure employing a small number of parts, as a double-purpose erasing apparatus wherein an operative means for character-erasing can be easily settable either at a single character-erasing position or at a consecutive character-erasing position, and the erasing apparatus can be surely operated only by depressing a predetermined type key or keys for erasing a single mistyped character or a series of consecutive mistyped characters.

DETAILED DESCRIPTION OF THE PREFERRED EMBODIMENT

With reference to the appended drawings a preferred embodiment of this invention will be described.

Figure 1:
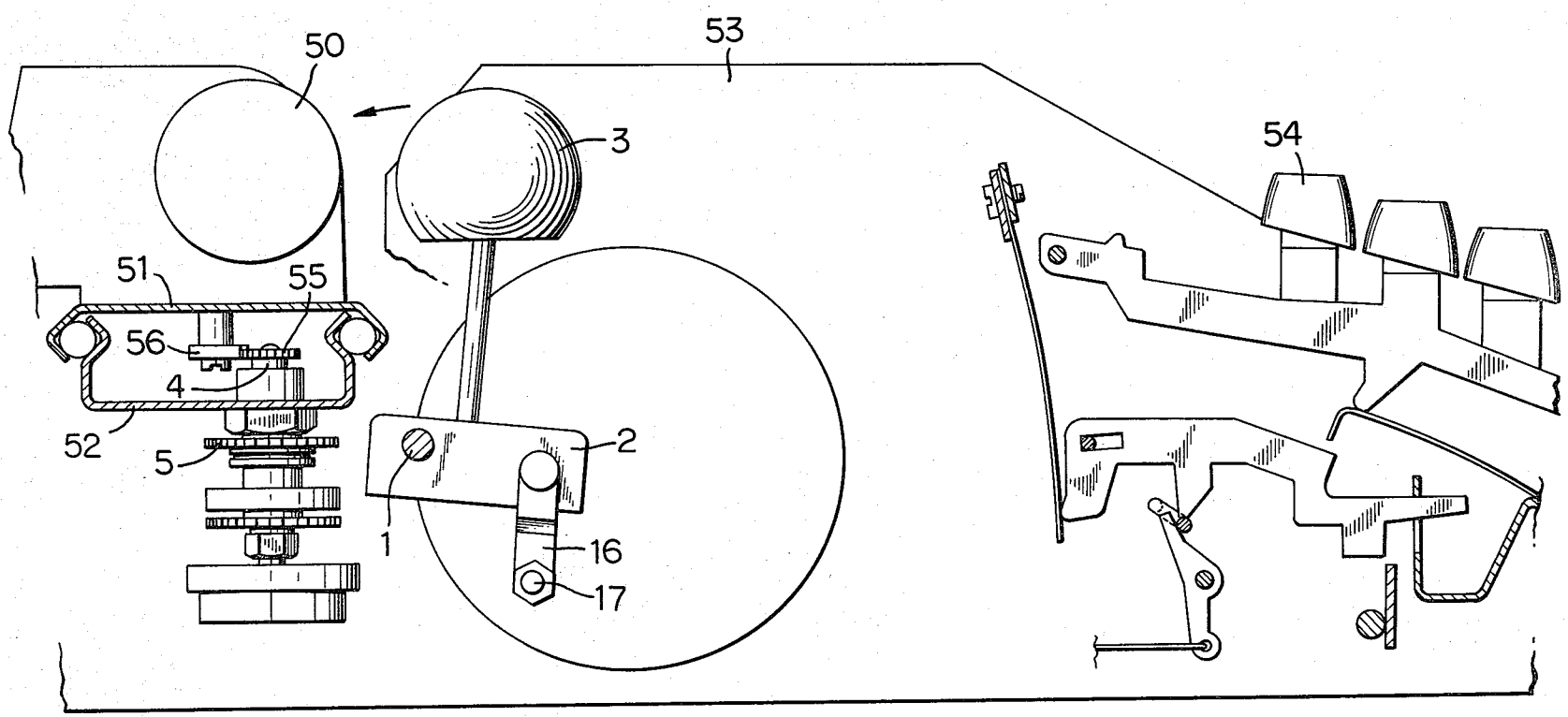
FIG. 1 is a sectional side elevation of an embodiment of a typewriter in accordance with this invention.

In FIG. 1, a platen 50 is disposed on the upper portion of a carriage 51 which is movably carried in a lateral direction on a base plate 52 placed on the rear portion of a typewriter frame 53. On the front side of the platen 50 a rocker platform 2 is pivoted by a rocker shaft 1. On the rocker platform 2 a print head 3 of substantially spherical form with a multiplicity of types arranged on the external surface thereof is retained inclinably as well as rotatably. Upon operation of a type key selected out of a multiplicity of type keys 54 arranged on the front side of the typewriter frame 53 the corresponding type on the print head 3 is so selected as to face a printing surface of the platen 50. The printing operation is executed by a rotary movement of the rocker platform 2 which causes the selected type to be struck on the printing paper via an ordinary ink ribbon. An escapement device for intermittently moving the carriage 51 in the printing direction in response to the printing operation will be explained next. On a shaft 4 rotatably supported on the earlier mentioned base plate 52 a pinion 55 engageable with a rack 56 and a ratchet wheel 5 for shifting the carriage 51 at a predetermined pitch are respectively fixed. The shaft 4 is rotatively biased via the rack 56 and pinion 55 in a direction indicated with an arrow in FIG. 2 due to biasing force given to the carriage 51 through a suitable means (not shown) in the printing direction.

Figure 2:
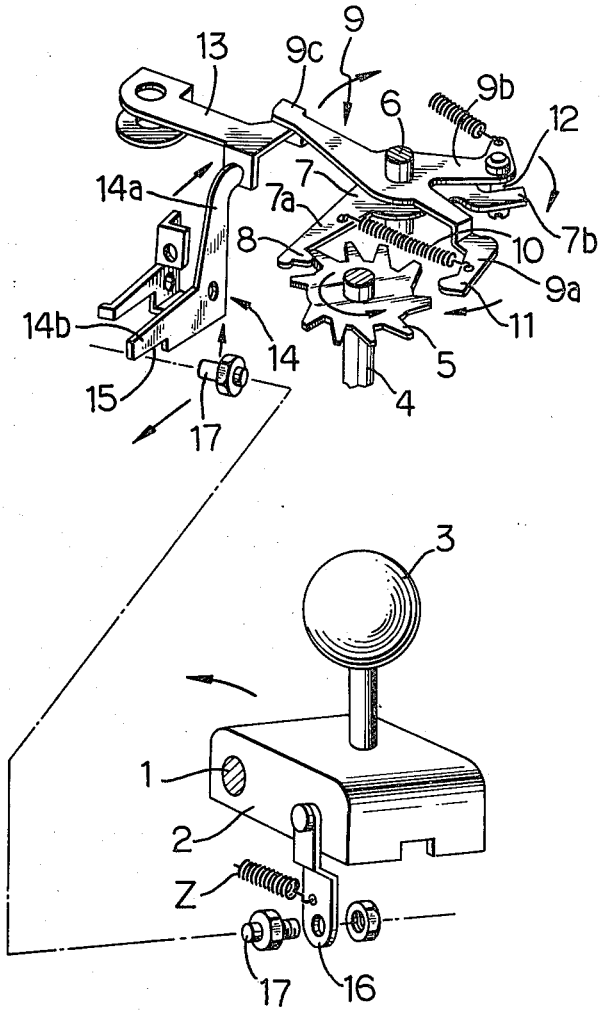
FIG. 2 is a perspective view for showing a rocker platform with a print head and an escapement device in the typewriter.

As shown in FIG. 2, on a shaft 6 extending in parallel to the shaft 4 on the rear side of the ratchet wheel 5 a first pawl 7 with a pair of arms 7*a*, 7*b* is rotatably retained: one arm 7*a* of the same is provided with an engagement section 8 engageable with the ratchet wheel 5, the other arm 7*b* extending in an opposite direction to the former.

On the shaft 6 a second pawl 9 of trifurcated arm shape is so carried as to be coaxially rotatable with the first pawl 7. Between a first arm portion 9*a* of the second pawl 9 and the one arm 7*a* of the first pawl 7 a tension spring 10 is anchored. The first arm portion 9*a* provided with an engagement section 11 is engaged with the ratchet wheel 5 on the opposite side, with the ratchet wheel 5 being sandwiched between the one arm portion 7*a* and the first arm portion 9*a*, to the one arm portion 7*a*.

On a second arm portion 9*b* of the second pawl 9 an eccentric screw 12 is secured for being engageable with the other arm portion 7*b* of the first pawl 7. Both pawls 7, 9 are therefore under the influence of the tension spring 10 normally in engagement so as to be rotatable in unison. A third arm portion 9*c* of the second pawl 9 is engaged with one side of a first crank 13 which is rotatably supported on an axis extending on the left side of and in parallel with the shaft 6, and is rotatable clockwise accompanied by the rotation of the first crank 13.

On the front side of the first crank 13 a second crank 14 is rotatably supported on an axis extending in a direction normal to the shaft 6. One arm portion 14*a* of the second crank 14 is engaged with the other side of the first crank 13 so as to make the first crank 13 rotate following the rotation of the second crank 14. The other arm portion 14*b* of the second crank 14 is provided with an engagement portion 15 for being constantly engaged, due to the action of a tension spring Z, with a pin 17 fixed on one end of connecting plate 16 which is pivoted about the other end thereof on one side of the rocker platform 2.

When, therefore, the rocker platform 2 has been anticlockwise rotated for printing, both pawls 7, 9 are integrally rotated in a clockwise direction by the action of the first and second cranks 13, 14 which are actuated by movement of the pin 17. Then the engagement between the engagement sections 8, 11 and the ratchet wheel 5 is respectively changed by one tooth so as to shift the carriage 51 by one half pitch or space in the printing direction. When thereafter the rocker platform 2 is restored to the original position, it brings both pawls 7, 9 back to the original position shown in FIG. 2 so as to further shift the carriage 51 by one half pitch. By repeating the above operation the carriage 51 is shifted in the printing direction intermittently at each printing operation of the print head 3.

Structure of an erasing apparatus for erasing mistyped character or characters will be described next referring to FIG. 3. On the front side of the platen 50 a ribbon vibrator 18 consisting of a pair of arms 18*a*, 18*b* which extend in a manner of sandwiching the print head 3 therebetween, and a connecting rod 18*c* for connecting both arms 18*a*, 18*b* is pivoted on the typewriter frame 53. The ribbon vibrator 18 supports at the upper end of both arms 18*a*, 18*b* an erase ribbon CR and is rotatably biased clockwise by a tension spring 19 mounted on the lower end of the arm 18*a*.

On the outer side of lower portion of the one arm 18*a* there is disposed in the form of a projection a cam follower 21 engageable with a cam 20 which is rotatable in response to depression of every type key 54. On the outer side of upper portion of the same arm (18*a*) two engaging pins 22, 23 are also disposed respectively as a projection.

Beneath the ribbon vibrator 18 a retaining member such as a crank 24 of substantially inverted U-shape operative for erasing is pivoted on the typewriter frame 53 rotatably about an axial line parallel to the rotation axis of the ribbon vibrator 18. On the lower end thereof a notch 24*a* of arcuate shape is formed and a tension spring 25 is anchored so as to rotatively bias the crank 24 in a counterclockwise direction. An arm portion 26 extending from the crank 24 is detachably engaged at the tip thereof with the one arm 18*a* of the ribbon vibrator 18. On another arm portion 27 of the crank 24 extending in the opposite direction to the arm portion 26 an engagement portion 28 is formed at the tip thereof, and an operating arm 29 is downwardly projected from the middle portion thereof.

Figure 6:
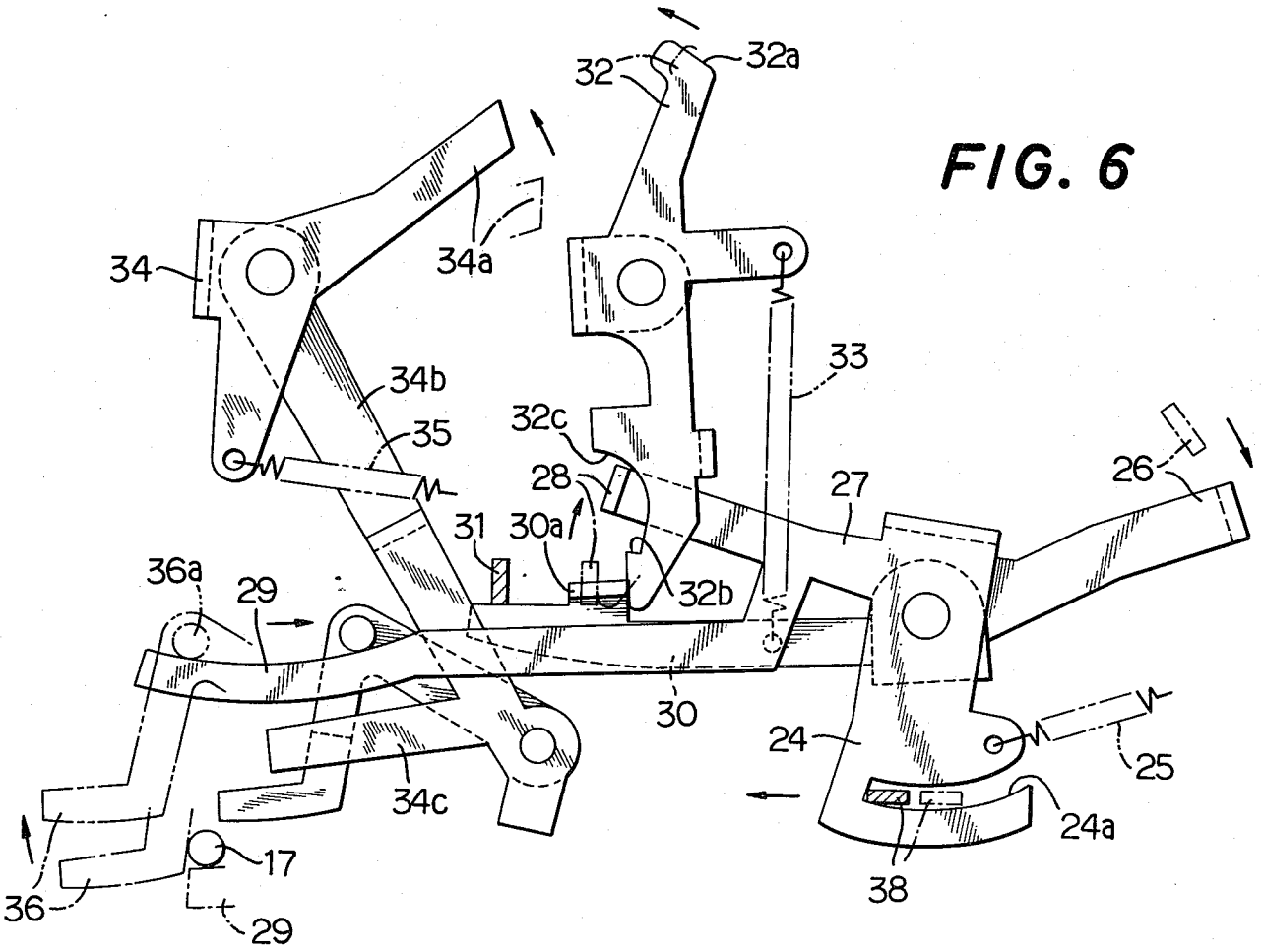

Inside the inverse U-shaped crank 24 a release lever 30 is disposed rotatably about the same axis as the crank 24. An engagement portion 30*a* formed in the neighborhood of the tip thereof is engageable with the engagement portion 28 of the crank 24. Rotation range of the release lever 30 is restricted by a stopper 31 secured on the typewriter frame 53 as shown in FIG. 6. Between the ribbon vibrator 18 and the crank 24 a lock link 32 is rotatably disposed for being rotatively biased in a counterclockwise direction by a tension spring 33 anchored between itself and the release lever 30, and a cam surface 32*a* on the upper end thereof is made engageable with the one engaging pin 22 on the ribbon vibrator 18. On the lower end of the lock link 32 an engaging portion 32*b* and a cam portion 32*c* continued arcuately thereabove are formed. The engaging portion 30*a* of the release lever 30 is normally engaged with the lower end of the lock link 32, with the engagement portion 28 of the crank 24 being in engagement with the lower portion of the lock link 32 at one side thereof as shown in FIG. 3.

On the rear side of the lock link 32 a crank 34 is rotatably mounted on the typewriter frame 53 under rotative biasing force in a counterclockwise direction by a tension spring 35. One arm portion 34*a* of the crank 34 is engaged with the other engaging pin 23 of the ribbon vibrator 18 so that the crank 34 is able to rotate following the rotation of the ribbon vibrator 18.

To the lower end of the other arm portion 34*b* of the crank 34 a disconnecting member such as a hook-shaped link 36 is rotatably connected and a pin 36*a* disposed substantially in the middle portion thereof is normally held in engagement with an engaging portion 34*c* disposed on the lower portion of the other arm portion 34*b*. The pin 36*a* is located within the rotational range of the operating arm 29 of the crank 24 so that it is engageable with the crank 24 when the same has been rotated as far as a second shifting position shown in FIG. 6.

On the front side of the link 36 there is a pin 17 connected to one side of the rocker platform 2 via the connecting plate 16, being normally in engagement with one side of the link 36.

Means for erasing a character or characters will be described hereunder. A correction key 37 for establishing a single character erasing status is retained at one end of a key lever. On the tip of an arm portion of the key lever a bent portion 37*a* is formed. Between the bent portion 37*a* and the notch 24*a* of the crank 24 a connecting plate 38 is spanned, which is forwardly biased by a tension spring 39. Between an engaging step portion 38*a* formed on a part of the connecting plate 38 and the bent portion 37*a* of the correction key 37 a space S is normally formed.

Adjacent to the correction key 37 a manual operating lever 40 for selectively establishing either one of the single character erasing position and the consecutive character erasing position is pivoted on the typewriter frame 53. On the free end of an arm portion thereof a pin 40*a* is projectingly disposed. The manual operating lever 40 is so held as to be switchable between the just mentioned two positions by the action of an over-center spring 41.

On the rear side of the correction key 37 a link 42 operative for erasing a series of characters is rotatably disposed. In a bifurcated portion 42*a* on top thereof the pin 40*a* is engaged. An arm portion 42*b* of the link 42 engages a bent portion 38*b* of the connecting plate 38.

When therefore erasing of a single character is desired the manual operating lever 40 is manually operated clockwise to be set at the single character erasing position, i.e. front position, and the correction key 37 is depressed. The connecting plate 38 is then moved rearwards against the spring force of the tension spring 39 through engagement of the bent portion 37*a* with the engaging step portion 38*a* of the connecting plate 38. Releasing the correction key 37 will immediately return the connecting plate 38 to the original position with the aid of the tension spring 39. For erasing a series of characters the manual operating lever 40 is turned counterclockwise for being switched to the consecutive character erasing position, i.e. rear position. The link 42 is rotated following the rotation of the manual operating lever 40 for shifting the connecting plate 38 rearwards by a predetermined amount through engagement of the link 42 with the connecting plate 38.

Shifting amount of the connecting plate 38 is so determined as to be larger in the case of consecutive character erasing than in the case of single character erasing. Therefore when the typewriter is set at the consecutive character erasing position the earlier mentioned space S is expanded, and consequently that position of the consecutive erasing is maintained without being affected by the operation of the correction key 37, because the bent portion 37*a* will not be engaged with the engaging step portion 38*a* of the connecting plate 38.

Function of the erasing apparatus will be described hereunder.

In case of mistyping of a single character the printing paper on the platen 50 is moved by one space or pitch in the reverse direction by depressing of a not-shown back space key, and then the manual operating lever 40 is set at the single character erasing position. Depression of the correction key 37 at this stage will shift the connecting plate 38, clockwise rotate the crank 24 from an original position in FIG. 4 to a first shift position in FIG. 5 and will make the engagement portion 28 of the arm portion 27 engage the engaging portion 32*b* of the lock link 32 so as to bring the crank 24 to a locked position. At this time the release lever 30 and the lock link 32 are held in engagement.

Figure 3:
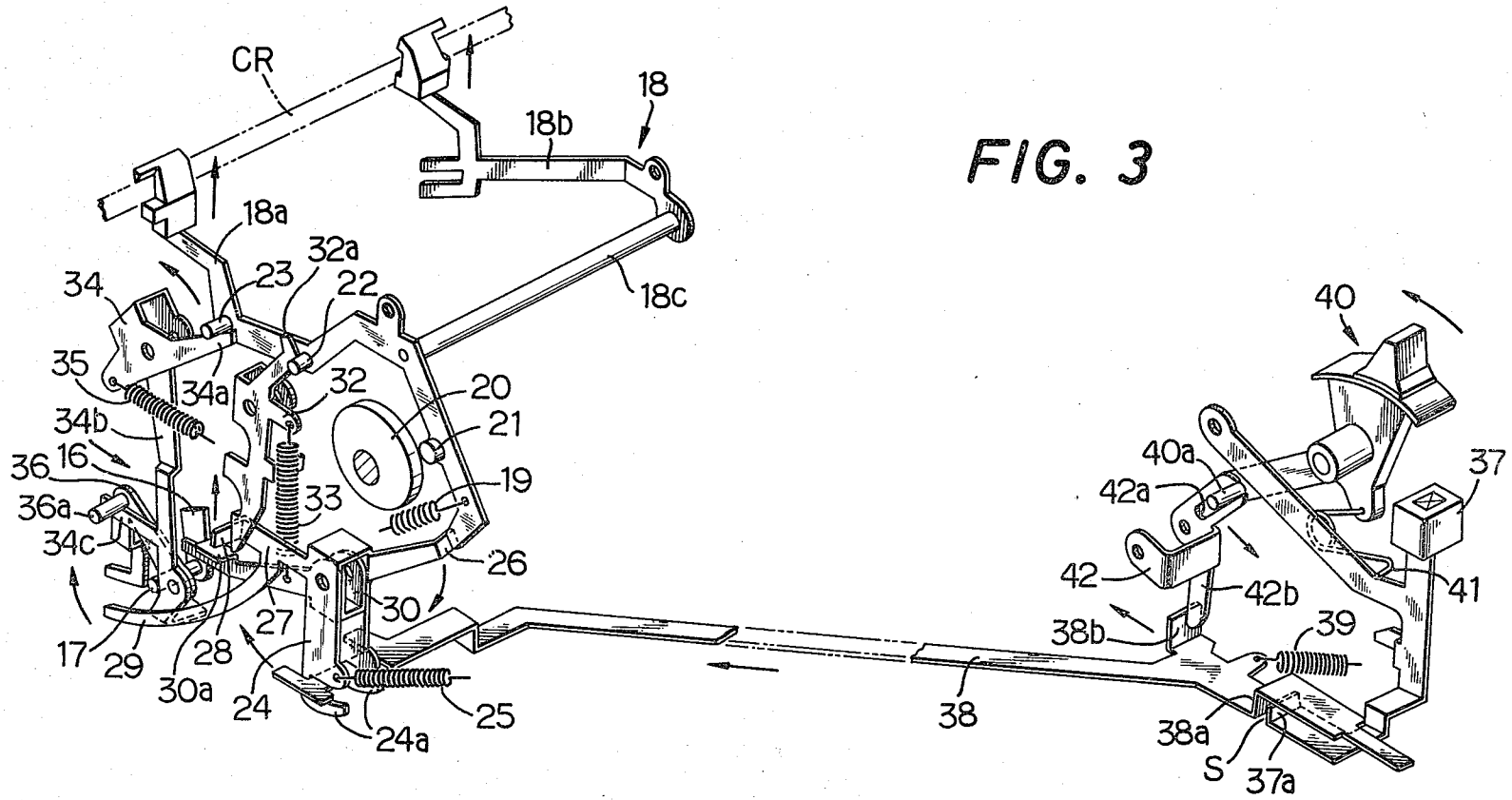
FIG. 3 is a perspective view of an erasing apparatus in the typewriter.

The rotation of the crank 24 will on the other hand disengage the arm portion 26 from the lower end of the one arm 18*a* of the ribbon vibrator 18, consequently clockwise rotating the ribbon vibrator 18 from the status in FIG. 3 with the aid of the spring force of the tension spring 19. Then, the ribbon vibrator 18 is set through engagement of the cam follower 21 with the cam 20 in a movable status from the original position to the printing position.

When thereafter the type key 54 is depressed again to start a printing action for erasing the single mistyped character, the ribbon vibrator 18 is lifted up to the printing position by the movement of the cam follower 21 caused by the rotation of the cam 20. The mistyped character is erased by the erase ribbon CR supported on the tip of the ribbon vibrator 18. The crank 34 is then counterclockwise rotated following the lifting movement of the ribbon vibrator 18 through engagement of the pin 23 with the arm portion 34*a*, accompanied by rotation of the link 36 together with the crank 34 through engagement of the pin 36*a* of the link 36 with the engaging portion 34*c* of the crank 34, so as to forwardly move the pin 17 which is in abutment on one side surface of the link 36 against the biasing force of the tension spring Z. This will allow the pin 17 to be forwardly disengaged from the engaging portion 15 of the second crank 14 in the escapement device in FIG. 2 for making the escapement device ineffective. Therefore printing operation due to depressing of the type key 54 will never cause a one-space movement of the printing paper on the platen 50 in the printing direction.

Figure 4:
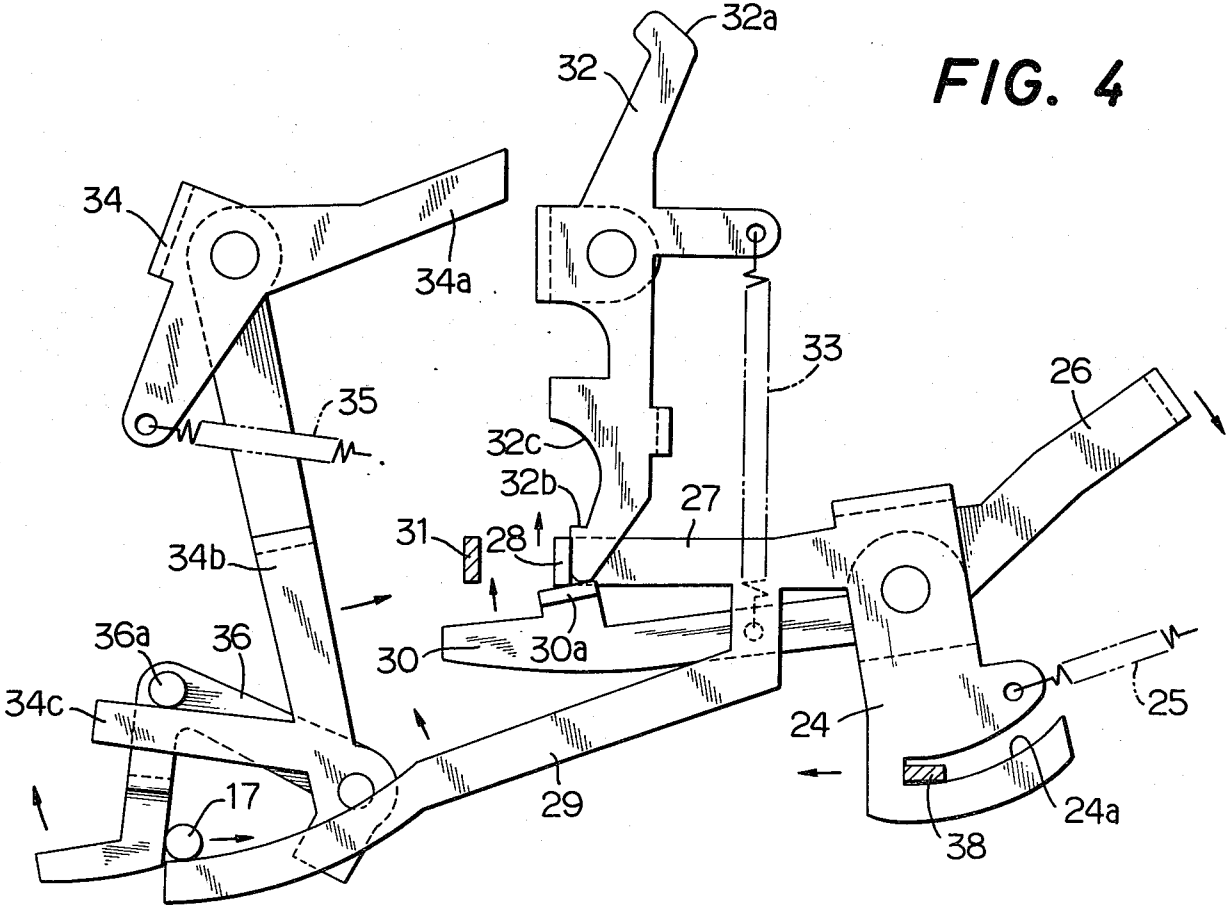
FIGS. 4–6 are respectively side views of an essential part of the erasing apparatus showing different operational status positions, respectively.
Figure 5:
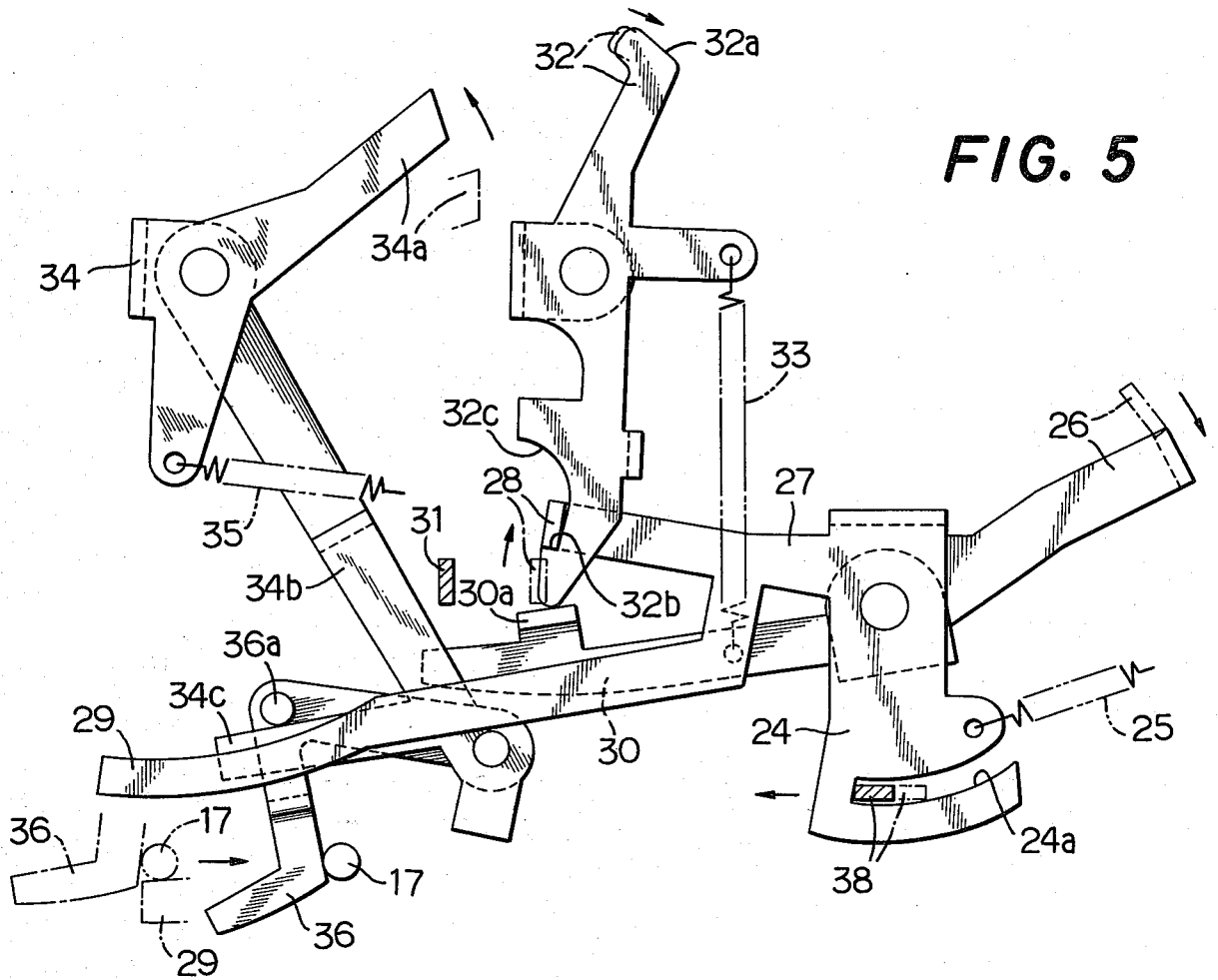

When the ribbon vibrator 18 is restored, after the mistyped character has thus been erased, to the original position the lock link 32 is counterclockwise rotated through engagement of the pin 22 with a cam portion 32*a* of the lock link 32 so as to release the engagement of the engaging portion 32*b* with the engagement portion 28 for allowing both the lock link 32 and the crank 24 to be respectively returned to the original position shown in FIG. 3 and FIG. 4. The crank 34 is then clockwise rotated due to the returning movement of the ribbon vibrator 18, accompanied by returning to the original position in FIG. 4 of the link 36 together with the pin 17, so as to return the pin 17 to an engaged status with the engagement portion 15 of the second crank 14 for making the escapement device effective or operative. This consequently permits printing operation with an ordinary ink ribbon accompanied by the subsequent intermittent movement due to depression of the type keys 54.

When a plurality of characters have been consecutively mistyped the printing paper on the platen 50 must be returned up to a position where the first of the series of mistyped characters was printed, by repeatedly depressing the back space key before the manual operating lever 40 is set by rearward turning thereof at the consecutive character erasing position. By this operation of the lever 40 which causes a shifting of the connecting plate 38, the crank 24 is widely swung from the original position in FIG. 4 passing through the first shift position in FIG. 5 to a second shift position shown in FIG. 6. The swing or rotation of the crank 24 will cause releasing of engagement of the lower end of the lock link 32 with the engagement portion 30*a* of the release lever 30 through rotation of the lock link 32 in a counter-clockwise direction which is motivated by engagement of the engagement portion 28 of the arm portion 27 with the arcuate cam portion 32*c* of the lock link 32. The release lever 30 is, upon disengagement from the lock link 32, clockwise rotated by the action of the tension spring 33, and allows the engagement portion 30*a* to be engaged with one side of the lower portion of the lock link 32 as shown in FIG. 6. The rotation of the release lever 32 is stopped by the stopper 31 while being maintained in engagement with the lock link 32.

In this instance engagement between the arm portion 26 and the one arm portion 18*a* of the ribbon vibrator 18 is, just like in the status when a single character is erased, released due to the rotation of the crank 24 for placing the ribbon vibrator 18 in a ready status to move to the printing position. Furthermore, the rotative movement of the crank 24 to the second shift position causes the operating arm 29 to engage the pin 36*a* on the link 36 as shown with a two-dot-chain line in FIG. 6 so as to clockwise rotate the link 36, which results in separation thereof from the pin 17.

When therefore printing operation is conducted at this status repeatedly by depressing consecutively one type key 54 after another corresponding to the consecutively mistyped plural characters, the ribbon vibrator 18 is lifted up to the printing position from the original position following the rotation of the cam 20 for allowing the erase ribbon CR to erase the mistyped characters. Accompanied by the lifting movement of the ribbon vibrator 18 both the crank 34 and the link 36 are counterclockwise rotated (see FIG. 3), leaving the pin 17 separated from the link 36. The escapement device is kept in operative position, because the pin 17 is not moved due to the just mentioned separation.

Even when the lock link 32 is counterclockwise rotated from the position in FIG. 6 by engagement of the pin 22 with the cam portion 32*a* when the ribbon vibrator 18 is lowered, the ready status of the ribbon vibrator 18 rotating from the original position to the printing position as well as the effective status of the escapement device are maintained, because the connecting plate 38 and the crank 24 are held in the illustrated position in FIG. 6 so long as the manual operating lever 40 is set at the consecutive character erasing position. The carriage 51 can be therefore intermittently moved in the printing direction, due to operation of the escapement device which is synchronous with the printing operation, for consecutively erasing the mistyped characters.

Even when the correction key 37 is depressed in the course of the erasing operation by mistake, it can not affect the erasing operation because the bent portion 37*a* does not abut on the engaging step portion 38*a* of the connecting plate 38.

When the manual operating lever 40 is switched to the single character erasing position after the above-mentioned character erasing operation has been finished the connecting plate 38 is restored to the original position in FIG. 3, followed by restorative rotation of the crank 24 due to the biasing force of the tension spring 25. The engagement of the arm portion 26 with the one arm 18*a* of the ribbon vibrator 18 causes separation of the cam follower 21 from the cam 20.

Rotative returning of the crank 24 accompanied by releasing of the engagement portion 28 from the cam portion 32*c* of the lock link 32 causes the engagement portion 28 to be counterclockwise rotated together with the release lever 30, due to engagement of the engagement portion 28 with the engagement portion 30*a* which is in the status shown in FIG. 6, and the lock link 32 is consequently restored to the original position shown in FIG. 4. Simultaneously, engagement of the operating arm 29 with the pin 36*a* of the link 36 is released for permitting the link 36 to be restored to the original position. All of the members are herewith restored to their respective normal position.

This invention is of course not to be limited to the above described embodiment, but many alterations or modifications are allowed for those skilled in the art within the spirit and scope of the invention. For example, a single correction key may be double-purposed such that when it is depressed as a first step the single character-erasing status is set and, further depression thereof as a second step producing the consecutive character-erasing status.

What is claimed is:

1. A typewriter having an erasing apparatus wherein an error character is erased by striking a type key corresponding to the error character and which comprises:

means for printing selected characters on paper;

escapement means, responsive to actuation of said printing means, for effecting relative movements between said paper and said printing means;

erasing means for supporting an erase ribbon and moving same from an original position to an operating position upon the actuation of said printing means;

a retaining member movable to first, second and third positions and normally positioned at said first position to keep said erasing means inoperative, said retaining member, when positioned at one of said second and third positions, allowing said erasing means to be operative;

manual operating means, associated with said retaining member, for selectively positioning said retaining member in one of said second and third positions to enable said erasing means to be operative responsive to the actuation of said printing means;

locking means, associated with said retaining member and said erasing means, for holding said retaining member in one of said second and third positions, said locking means causing said retaining member to be held in said second position and permitting said retaining member to return to said first position in response to the return movement of said erasing means, said locking means holding said retaining member in said third position such that the retaining member in said third position allows said erasing means to be kept operative; and escapement control means, associated with said erasing means, for disengaging said escapement means when said retaining member is in said second position, and keeping same operative while said retaining member is held in one of said first and third positions, whereby the erasing apparatus is capable of erasing a single character and typing in a correct character in place thereof while said retaining member is set in said second position, and is capable of erasing a series of characters in a consecutive manner in a direction in which the selected characters are printed by said printing means, while said retaining member is set and held in said third position.

2. A typewriter as claimed in claim 1, wherein said manual operating means includes a first manual member operatively connected to said retaining member to move same to the second position and a second manual member operatively connected to said retaining member to move same to the third position.

3. A typewriter as claimed in claim 2, wherein said locking means includes a lock link having an engaging portion, and said retaining member has an engagement portion engageable with said engaging portion to hold said retaining member at the second position, and said locking means further includes an over-center spring maintaining said second manual member at one of its original position and operated position and holding said retaining member at the third position.

4. A typewriter as claimed in claim 3, wherein said erasing means includes a ribbon vibrator lifting said erase ribbon from its original position to its printing position and having a projection, and said lock link is provided with a first cam portion engageable with said projection upon returning of said ribbon vibrator from the printing position to the original position, said first cam portion causing said lock link to disengage from said retaining member thereby permitting same to be spring-returned to the first portion after a single character has been erased.

5. A typewriter as claimed in claim 4, wherein said engaging portion of said lock link is provided with a second cam portion engageable with said engagement portion of said retaining member to retain said lock link at a position where said lock link does not engage at the first cam portion thereof said ribbon vibrator when said retaining member is in the third position.

6. A typewriter as claimed in claim 1, wherein said erasing apparatus further comprises connecting means for operatively connecting said printing means to said escapement means for effecting said relative movement upon the actuation of said printing means.

7. A typewriter as claimed in claim 6, wherein said printing means includes a print head, a rocker shaft, and a rocker platform pivoted by said rocker shaft and supporting said print head, said connecting means including a connecting plate pivoted at one end thereof on said platform about an axis parallel to said rocker shaft and an engaging pin fixed to the other end of said connecting plate, said connecting means further including another connecting member detachably engaging said engaging pin, and wherein said escapement control means includes a disconnecting member engageable with said engaging pin for disengagement thereof from said another connecting member to disconnect said escapement means from said printing means.

8. A typewriter having an erasing apparatus comprising:

printing means for striking selected types against record medium on a platen;

escapement means, responsive to actuation of said printing means, for longitudinally moving said platen in increments of one-character space;

connecting means for operatively connecting said printing means to said escapement means to operate the latter upon each actuation of said printing means;

cam means driven in timed relation with said printing means;

a ribbon vibrator pivotally disposed and supporting at a free end thereof an erase ribbon, said ribbon vibrator being engageable with and pivoted by said cam means for lifting said erase ribbon from an original position to an operating position upon the actuation of said printing means;

a retaining crank pivotable to first, second and third positions and having an arm which, when said retaining crank is in said first position, engages said ribbon vibrator and prevents same from following said cam means, said arm being out of engagement with said ribbon vibrator when said retaining crank is in one of said second and third positions thereby allowing said ribbon vibrator to follow said cam means;

a first manual member operatively connected to said retaining crank and, when manually actuated, pivoting said retaining crank from said first position to said second position to set same ready to operate;

a second manual member operatively connected to said retaining crank and, when manually operated to an operative position, pivoting said retaining crank from said first position to said third position to set said ribbon vibrator ready to operate, said retaining crank set in said third position being kept out of control by said first manual member;

means for maintaining said second manual member at said operative position;

a lock link engageable with said retaining crank set in said second position and holding same in said second position, said lock link being engageable also with said ribbon vibrator upon returning thereof to said original position and disengaged from said retaining crank in said second position, thereby allowing said retaining crank to return to said first position; and a disconnecting link actuated by said ribbon vibrator and disconnecting said connecting means to disengage said escapement means from said printing means when said retaining crank is in said position, said disconnecting link being engageable with said retaining crank set in said third position and enabling said connecting means to connect said escapement means to said printing means.

9. A typewriter as claimed in claim 8, wherein:

said printing means includes a print head, a rocker shaft, and a rocker platform pivoted by said rocker shaft and supporting said print head;

said connecting means includes a connecting plate pivoted at one end thereof on said platform about an axis parallel to said rocker shaft and a connection pin fixed to the other end of said connecting plate, said connecting means further including another connecting member detachably engaging said connection pin;

said disconnecting link includes another crank engageable with said ribbon vibrator, and a hook-shaped member pivoted on said another crank, said hook-shaped member being engageable with said connection pin to disengage same from said another connecting member; and said retaining crank further has another arm engageable with said hook-shaped member, when said retaining crank is in said third position, to move said hook-shaped member to a position at which said hook-shaped member is not engageable with said connection pin whereby said disconnecting link does not disconnect said escapement means from said printing means when said retaining crank is in said third position.

10. A typewriter as claimed in claim 9, wherein:

said ribbon vibrator includes a first projection disposed on one side of the pivoting axis thereof and following said cam means, and a pair of second projections on the other side of said pivoting axis;

said retaining crank includes a first engaging arm slidably engageable with one of said pair of second projections;

said another crank includes a second engaging arm slidably engageable with the other of said second projections; and said hook-shaped member includes a projection engageable with said another arm of said retaining crank set in said third position.

11. A typewriter having an erasing apparatus, which comprises:

means for printing selected characters on paper;

escapement means, responsive to actuation of said printing means, for effecting relative movements between said paper and said printing means;

erasing means including an erase ribbon and a ribbon vibrator supporting said erase ribbon and pivotally moving same from an original position to an operating position upon the actuation of said printing means;

a retaining member movable to first, second and third positions and normally positioned at said first position to keep said ribbon vibrator inoperative in said original position, and said retaining member, when positioned, at one of said second and third positions, allowing said ribbon vibrator to be operative;

manual operating means, associated with said retaining member, for selectively positioning said retaining member in one of said second and third positions to enable said erasing means to be operative responsive to the actuation of said printing means;

locking means, associated with said retaining member and said erasing means, for holding said retaining member in one of said second and third positions, said locking means causing said retaining member to be held in said second position and permitting same to return to said first position in response to the return movement of said ribbon vibrator to said original position, said locking means holding said retaining member in said third position such that the retaining member in said third position allows said ribbon vibrator to be kept operative; and escapement control means, associated with said erasing means, for disengaging said escapement means when said retaining member is in said second position, and keeping same operative while said retaining member is held in one of said first and third positions, whereby the erasing apparatus is capable of erasing a single character and typing in a correct character in place thereof while said retaining member is set in said second position, and is capable of erasing a series of characters in a consecutive manner in a direction in which the selected characters are printed by said printing means while said retaining member is set and held in said third position.

* * * * *